United States Patent [19]

Bowen

[11] Patent Number: 4,904,834

[45] Date of Patent: Feb. 27, 1990

[54] MIXING ATTACHMENT FOR MICROWAVE OVEN TURNTABLES

[75] Inventor: Robert F. Bowen, Burlington, Mass.

[73] Assignee: Raytheon Company, Lexington, Mass.

[21] Appl. No.: 109,004

[22] Filed: Oct. 16, 1987

[51] Int. Cl.[4] ..... H05B 6/78

[52] U.S. Cl. ..... 219/10.55 E; 219/10.55 F; 219/10.55 M; 99/348; 99/DIG. 14; 366/146; 366/228; 366/231

[58] Field of Search ..... 219/10.55 F, 10.55 E, 219/10.55 R, 10.55 M; 99/348, 451, DIG. 14, 409; 366/144, 146, 231, 233, 219, 228

[56] References Cited

U.S. PATENT DOCUMENTS

| | | | |
|---|---|---|---|
| 1,762,094 | 6/1930 | Goetz | 366/231 |
| 1,772,083 | 8/1930 | Hollenback | 366/231 |
| 3,430,927 | 3/1969 | Pouzar | 366/231 X |
| 3,810,605 | 5/1974 | Lambert | 99/348 |
| 4,434,343 | 2/1984 | Bowen et al. | 219/10.55 F |
| 4,471,195 | 9/1984 | Ishii et al. | 219/10.55 E |
| 4,571,474 | 2/1986 | Pomroy | 219/10.55 F |
| 4,598,635 | 7/1986 | Clegg | 99/348 |

FOREIGN PATENT DOCUMENTS

| | | | |
|---|---|---|---|
| 219406 | 4/1987 | European Pat. Off. | 219/10.55 E |
| 3417745 | 4/1984 | Fed. Rep. of Germany . | |
| 1477820 | 3/1967 | France . | |
| 56-12930 | 2/1981 | Japan | 219/10.55 E |
| 1193842 | 11/1985 | U.S.S.R. | 219/10.55 F |
| 453937 | 9/1936 | United Kingdom | 99/348 |
| 2082430 | 8/1981 | United Kingdom . | |
| 2159027 | 5/1984 | United Kingdom . | |

*Primary Examiner*—Philip H. Leung

*Attorney, Agent, or Firm*—Steven C. Stewart; William R. Clark; Richard M. Sharkansky

[57] ABSTRACT

A mixing attachment for stirring sauces, foods, mixtures or the like in a microwave oven. The mixing attachment includes a vertical mixing arm, a stationary blade attached to the bottom of the arm, and a cross beam, which is fastened to the top of the vertical mixing arm. The cross beam is secured to the walls within the microwave oven. One way to implement the mixer is to extend the arm downward into a cooking dish. The cooking dish contains food and rests on a turntable. When cooking food, the turntable rotates causing the food to be mixed by the stationary blade. In addition, the blade may be made to move up and down by the rotating turntable through a series of cams and a drive wheel.

17 Claims, 4 Drawing Sheets

MIXING ATTACHMENT FOR MICROWAVE OVEN TURNTABLES

BACKGROUND OF THE INVENTION

This invention relates to the heating of various liquids, food, or mixtures by microwave energy and has particular reference to appliances for cooking sauces, hot cereals or the like with a microwave oven.

It is commonly known that heat may be applied to foods in liquid or mixture form. These foods may be heated by radiation or convection on well-known conventional stoves. The stoves may be fueled by electrical energy, by the burning of liquid or gaseous fuel or by the combustion of solid fuel. One way to heat sauces is in an ordinary cooking pot. The food in the pot is then stirred with a spoon while held above an open flame. The heat from the flame is usually concentrated in one area. This may cause the bottom of a pot to have an uneven distribution of heat.

The ingredients within food tend to separate as the food is heated. To prevent separation, the contents of the cooking pot must be stirred while the food is being heated. Mixing of the sauce will more evenly distribute heat and prevent burning of the sauce.

Sauce can also be heated in container within a microwave oven. To more evenly heat the sauce, the sauce must be stirred. Stirring is done by first turning off the oven. Second the microwave oven must be opened. Third, the container holding the sauce is removed. Fourth, using ordinary cooking utensils, the sauce is stirred. Finally, the user must then place the container back into the microwave oven for further heating.

It has been found that this method is inconvenient to the microwave oven user. The user must stand over the microwave oven. At set intervals the user must stop the cooking process to stir the sauce.

If food is not stirred when cooked, the food must be cooked longer. Finally, parts of the food may be overcooked and other parts undercooked.

SUMMARY OF THE INVENTION

In accordance with the present invention, an apparatus adapted for mixing food in a rotating utensil positioned in a microwave oven, is provided with a shaft extending downwardly into the food and the rotating utensil, and means for holding the shaft in a fixed position relative to the rotating food wherein said food is mixed by flowing across the shaft. It may be preferable that the invention further comprise a panel connected to the shaft. Also, the bottom of the shaft may be wider and flatter than the top of the shaft. Further, it may be preferable that the holding means comprises a substantially horizontal bar removably engaging opposing walls of the microwave oven. The apparatus could further comprise means for moving the shaft up and down in a vertical direction.

The invention may further be practiced by an apparatus comprising a microwave oven, a microwave transparent shaft removably positioned in the cavity of the microwave oven, the shaft extending downwardly adapted to be inserted into food in a rotating container, a horizontal member, means for supporting the horizontal member in an elevated position, means for attaching the upper section of the shaft to the horizontal member, and a means connected to the lower section of the shaft for contacting the food wherein the food flowing past the contacting means is mixed. It may be preferable that the invention further comprise a container for holding the food, and means for rotating the container. It may be preferable that the attaching means comprise means for adjusting the height of the contacting means in the container. Further, it may be preferable that the contacting means is removable from the shaft.

The invention may also be practiced by an apparatus comprising a microwave oven, the oven comprising a back wall, two opposing side walls, a microwave transparent vertically oriented shaft removably positioned in the cooking cavity of the oven, the shaft extending downward into food in a rotating container, a microwave transparent horizontal arm, means for fastening the arm to one of said walls in an elevated fixed position, means coupled to said arm for attaching the top of the shaft to the arm, a microwave transparent blade in contact with the food, and means for securing the bottom of the arm to the blade. It may be preferable that the apparatus comprises means for adjusting the attaching means for changing the height of the blade from the bottom of the container. The apparatus could further comprise a means for removing the blade from the arm for replacement in cleaning.

The invention may further be practiced by an apparatus comprising a microwave oven comprising two opposing side walls, a microwave transparent vertically oriented shaft removably positioned in a cavity within the oven, the shaft extending downward into food in a rotating container, a microwave transparent horizontal arm, means for fastening both ends of the arm to the opposing walls in an elevated position, means coupled to the arm for attaching the top of the shaft to the arm, a microwave transparent blade adapted to be in contact with the food, and means for securing the bottom of the arm to the blade. It may be preferable that the arm comprise a first arm section, the first arm section having a constant external diameter from end portion to end portion, the outer end portion of the first arm section connected to the fastening means, the inner portion of the first arm section having an opening therein of a size to receive a second arm section, said second arm section having a constant nominal external diameter from end portion to end portion, the outer portion of the second arm section connected to the fastening means, the second arm section being telescopically, slidably received within the first arm section and means connected to the first and second arm section for adjusting the length of the arm assembly within the limits of the range of telescopic movement.

The invention may further be practiced by an apparatus comprising a microwave transparent vertically oriented shaft removably positioned in a cavity within a microwave oven, the shaft extending downward into food in a rotating container, a microwave transparent horizontal arm, means coupled to the arm for attaching the top of the shaft to the arm, a microwave transparent blade adapted to be in contact with the food, means for securing the bottom of the arm to the blade, a downwardly extending member coupled to the horizontal arm, and means for securing the member to the oven floor for preventing movement of the arm.

The invention may also be practiced by an apparatus comprising a microwave oven, a microwave transparent shaft removably positioned in the cavity of the microwave oven, the shaft extending downwardly for insertion into food in a rotating container on a turntable, vertically oriented hollow tube containing a first cammed shaft over a second cammed shaft, means for preventing rotation of the first cammed shaft, means for securing the tube to the oven, a drive wheel comprising a permanently centered shaft fastened to the oven, means for connecting the drive wheel to the turntable to rotate the drive wheel, means for connecting the drive wheel to the second cammed shaft to rotate the second cammed shaft, a horizontal arm located above the downwardly extending shaft and the first cammed shaft, means for fastening one end of the horizontal shaft to the top of the first cammed shaft, and means for fastening the horizontal shaft to the top of the second downwardly extending shaft. It may preferable that the apparatus further comprise a blade coupled to the bottom of the shaft wherein the food is mixed by flowing across the blade.

The invention may also be practiced by the method of stirring food in a microwave oven cavity comprising the steps of positioning the food to be stirred in a container within the cavity of the oven, supporting a shaft extending downwardly into the food in a container, rotating the container and holding the shaft in a fixed position relative to the rotating food wherein the food is mixed by flowing across the shaft. It may be preferable that the method further comprise the step of moving the shaft up and down in a vertical direction while the food is being mixed by flowing across the shaft.

BRIEF DESCRIPTION OF THE DRAWINGS

The above-mentioned and other features of the invention will now be more apparent by reading the Description of the Preferred Embodiment with reference to the drawings wherein.

DESCRIPTION OF THE PREFERRED EMBODIMENTS

Figure 1:
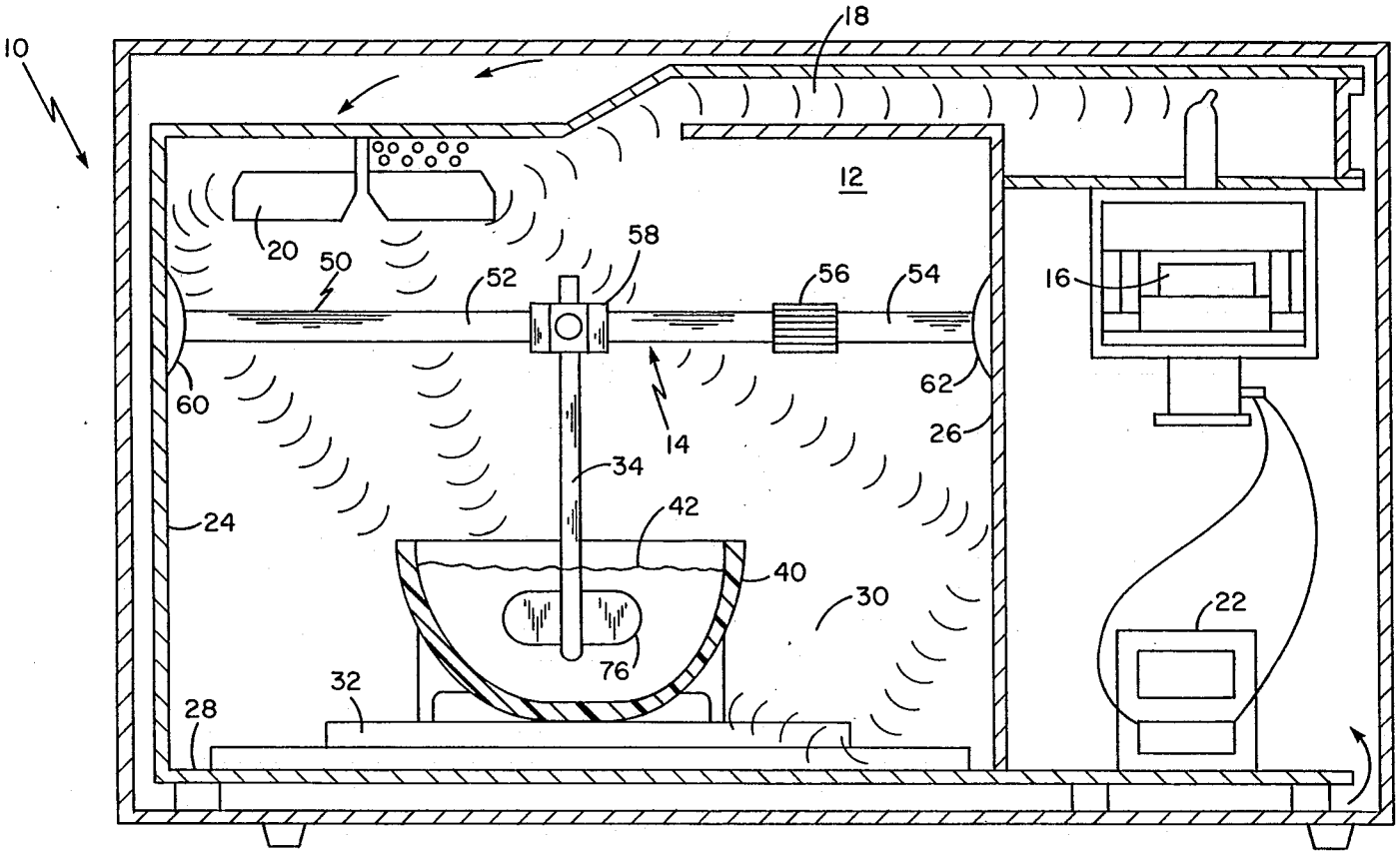
FIG. 1 is a front sectioned view of a microwave oven with a mixing attachment located within the oven cavity.

Referring more particularly to the drawing wherein like characters of reference designate like parts throughout the several views, there is shown in FIG. 1 a microwave oven 10 including an oven cavity 12 having a microwave oven mixer 14 which may be positioned therein through a door (not shown). The oven cavity is supplied with microwave oven energy from a magnetron 16 via a waveguide 18. While the magnetron 16 may generate energy at any desired frequency, a frequency of about 2.45 KMH is particularly suitable.

The cathode of magnetron 16 is supplied with filament heater power and anode voltage power at a voltage of, for example, 4000 volts from a high-voltage power supply 22 by suitable wiring while the anode of the magnetron 16 is ground.

As is known in the art, the microwave oven further comprises a left opposing side wall 24, a right opposing side wall 26, a floor 28, and a back wall 30. In the cavity is a mode stirrer 20 for distributing microwave energy. In addition, FIG. 1 shows the microwave oven mixer 14 in the operating position in a microwave oven 10 over a turntable 32. The microwave oven mixer 14 contains a vertical mixing shaft 34 which extends downward into a cooking utensil 40 or container. The cooking utensil 40 rotates during the heating process causing food 42 to be mixed. This mixing process will be explained in further detail herein.

Figures 2, 3:
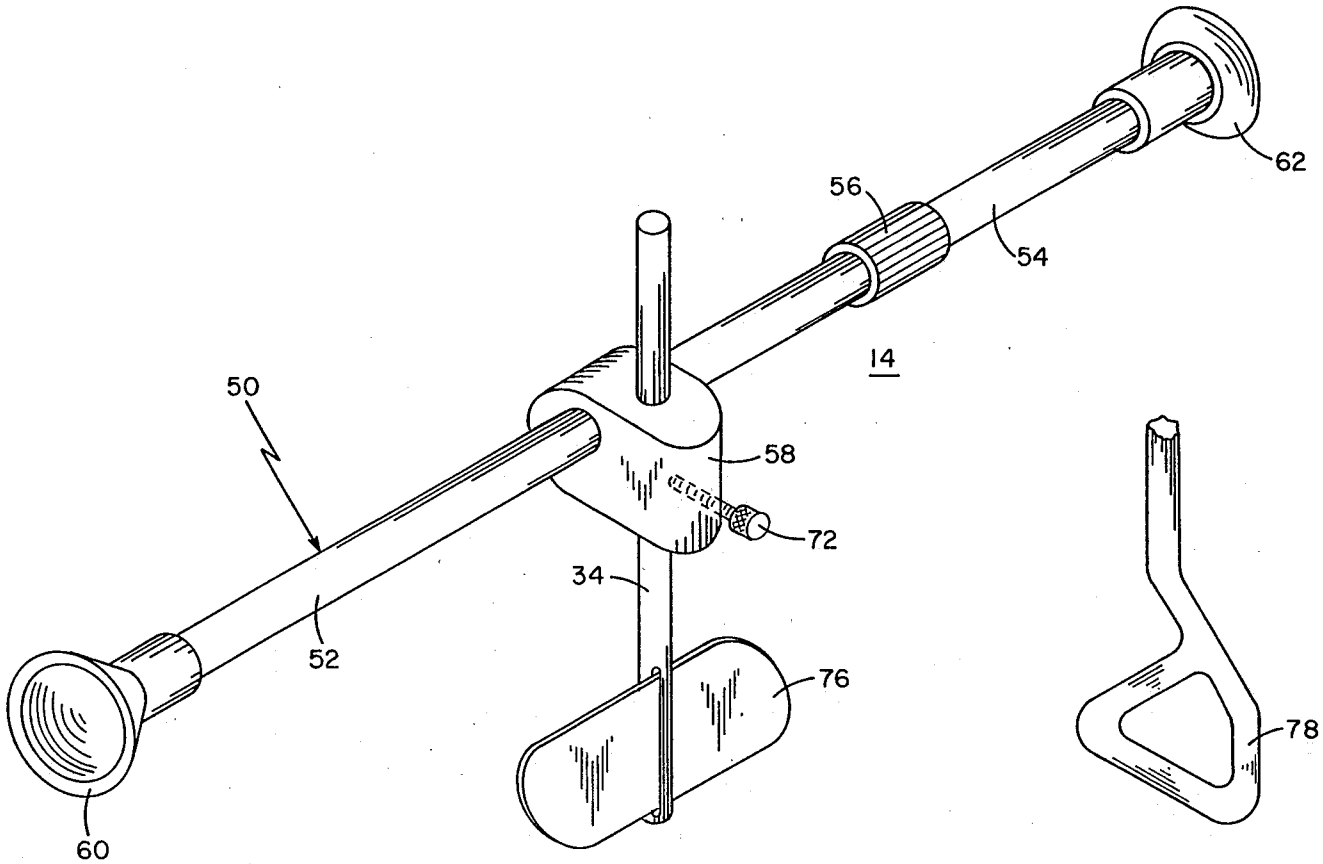
FIG. 2 is an expanded perspective view of the mixing attachment shown in FIG. 1.
FIG. 3 is a perspective view of an alternate embodiment of the downwardly extending shaft shown in FIG. 2.

Referring now to FIG. 2, there is shown side view of the microwave oven mixer 14 shown in FIG. 1. The microwave oven mixer 14 has a horizontal shaft 50 or arm which is attached to a left end suction cup 60 and to a right end suction cup 62. Although shaft 50 is shown in a horizontal orientation, shaft 50 could be oriented with an incline. The horizontal shaft 50 is made up of a left arm section 52 which telescopically surrounds a right arm section 54. Between the left arm section 52 and the right arm section 54 is a telescopic adjuster 56. This telescopic adjuster 56 allows the horizontal shaft 50 to extend outward to enable the left end suction cup 60 and the right end suction cup 62 to make contact with walls 24 and 26. Once the suction cups 60 and 62 are extended, the telescopic adjuster 56 can be rotated to lock the left arm 52 and right arm 54 in place.

Located near the center of the horizontal shaft 50 is an adjustable support 58. This adjustable support 58 allows the horizontal shaft 50 to support a vertical mixer shaft 34. Further, this adjustable support allows the vertical mixer shaft 34 to be raised or lowered. The adjustable support 58 holds the vertical mixer shaft 34 in a fixed position perpendicular to horizontal shaft 50. The support 58 prevents the rotation of the vertical mixer shaft 34.

The vertical mixer shaft 34 extends downwardly and at its base connects to a removable mixing blade 76 or paddle. Mixing blade 76 and shaft 34 are positioned to be inserted into the food 42 to be stirred. This mixing blade 76 would then mix the food 42, the details of which will be explained later herein.

Referring now to FIG. 3, there is an alternate embodiment of the downwardly extending shaft 34 shown in FIG. 2. This microwave oven mixer 14 contains the same elements as the mixer 14 shown in FIG. 2 with the exception of mixing blade 76. In place of the blade 76 is a closed loop end 78. The closed loop end 78 makes contact with the food 42 in a container 40. Food 42 is mixed by contact with this closed loop end 78, the details of which will be explained later herein.

Figure 4:
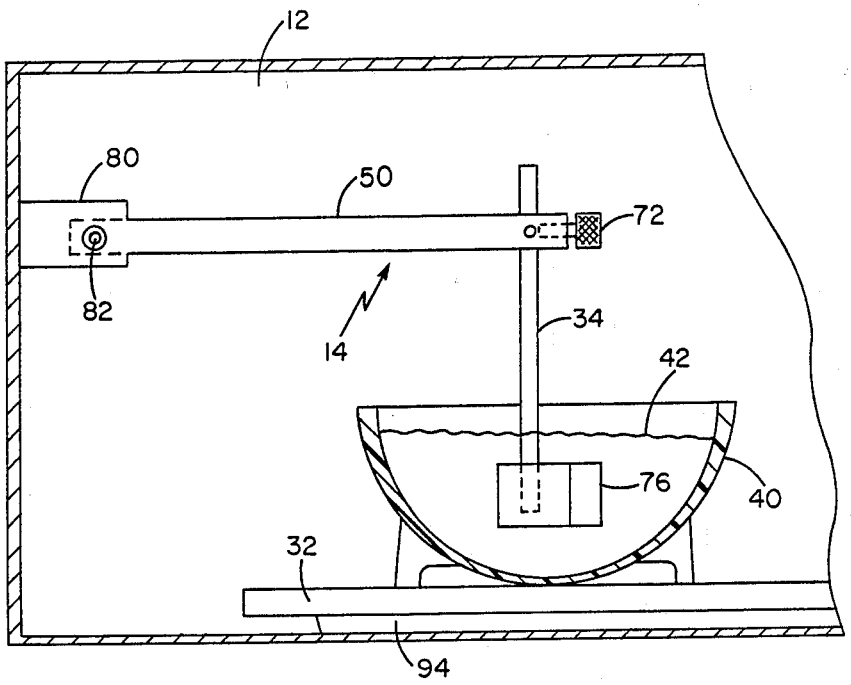
FIG. 4 is a front view of an alternate embodiment of the mixing attachment of FIG. 1 as mounted to the back wall of the microwave oven.

Referring to FIG. 4, an alternate embodiment of the microwave oven mixer 14 in a microwave oven cavity 12 with a built-in turntable 32 is shown. The microwave oven mixer 14 contains a support block 80 attached to horizontal shaft 50. This support block 80 is secured to the back wall 30 of the oven 10. The horizontal shaft 50 extends from support block 80 to the center of the oven cavity 12 and the center of the built-in turntable 32. A verticle mixer shaft 34 extends downwardly into a bowl or cooking utensil 10 on turntable 32. Mixing blade 76 is attached to the end of the shaft 34. Mixing blade 76 is located within the utensil 40.

The actual mixing occurs when the turntable 32 rotates a container 40 holding food 42. The food 42 then flows across blade 76 which is stationary, and mixes the food 42. This mixing occurs while food 42 is being heated by microwave energy. The mixing blade 76 is easily detachable from the end of the shaft 34. Mixing blade 76 may be replaced with a variety of different blades for different applications and food types.

The vertical mixing shaft 34 may be adjusted in a vertical direction. This vertical placement of the shaft 34 is controlled by lock screw 72. Another lock screw 82 secures the horizontal shaft 50 to support block 80.

Figure 5:
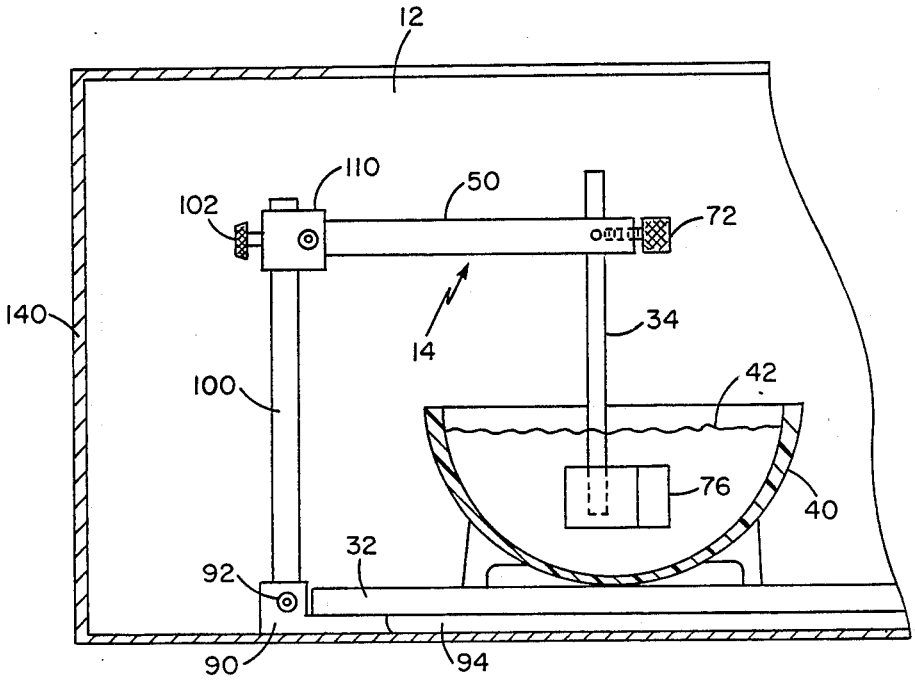
FIG. 5 is a front view of an alternate embodiment of the mixing attaching of FIG. 1 as mounted to the portable turntable.

Referring to FIG. 5, an alternative embodiment of mixer 14 is shown attached to a portable turntable 32 located within the microwave oven cavity 12. A section unit 90 is attached to the base 94 of the turntable 32. A vertical support shaft 100 is positioned next to the moving element of the turntable 32 on section unit 90. The vertical support shaft 100 is secured to base 94 by a lock screw 92 or other type device. A mounting block 110 is located above the vertical support shaft 100. This mounting block 110 has a hole in it. Block 110 fits over the vertical support shaft 100 and can be moved up and down on the support shaft 100. The mounting block 110 is secured to the vertical support shaft 100 by means of a locking screw 102. Mounting block 110 also attaches to horizontal shaft 50. A horizontal shaft 50 is located directly over the turntable 32. The mixer shaft 34 and the other components in FIG. 5 function in the same ways as the like components, as described with reference to FIG. 4.

Figure 6:
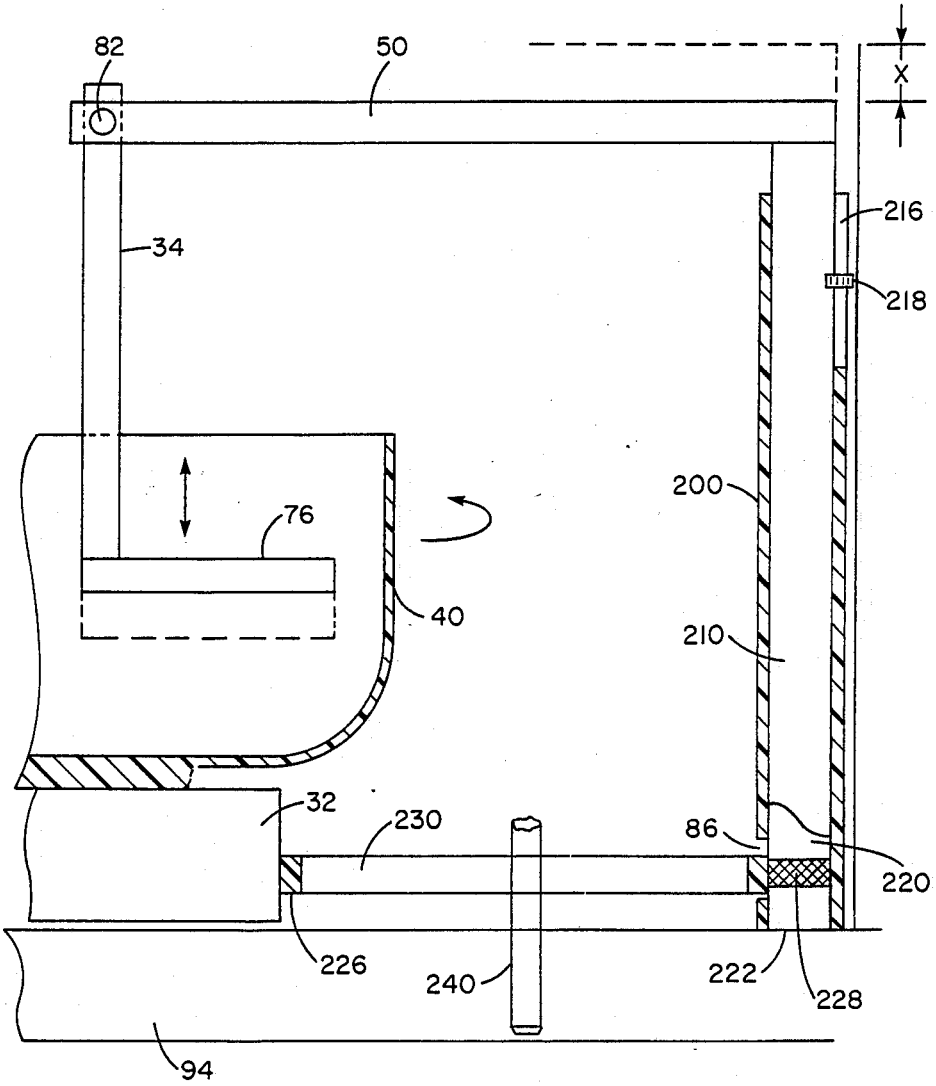
FIG. 6 is a front view of the mixing attachment of FIG. 5 furhter including a vertical action mechanism.

FIG. 6 is, a side view looking directly into microwave oven cavity. FIG. 6 shows an added feature which will allow automatic vertical action of the mixing blade 76 to take place. In place of the vertical support shaft 100 is a hollow tube 200. Within the hollow tube 200 is a vertical upper cammed shaft 210 connected to a horizontal shaft 50. Also within hollow tube 200 and below upper cammed shaft 210 is a lower or rotating cammed shaft 220. Engraved on cammed shaft 220 is pin follower 228.

The surface of upper end of the rotating cammed shaft 220 matches the surface of lower end of the upper cammed shaft 210. These shafts 210 and 220 touch near the bottom of the hollow tube 200. In the side of the top of the hollow tube 200 is vertical slot 216. A pin 218 is inserted through tube slot 216 into upper cammed shaft 210, preventing rotation of upper cammed shaft 210. Pin 218 allows cammed shaft 210 to move only in a vertical direction.

The hollow support tube 200 has a quadrant removed at 86 opposite the center of a drive wheel 230. This allows the periphery 226 of the drive wheel to come in contact with drive surface 228. The drive wheel 230 rotates on a permanently centered drive wheel shaft 240 and is in direct contact with rotating turntable 32. A band of silicone or other similar material could be used on the outside diameter of the drive wheel 230 to ensure good contact to both turntable 32 and periphery 226. The base of the turntable 32 is extended to support the drive wheel shaft 240 and the vertical hollow tube 200.

Drive wheel 230 could also be geared at its follower 226 to ensure more positive action. Here, periphery 226 is knurled to allow rotating cammed shaft 220 better contact with drive wheel 230. A bearing 222 could be provided beneath the rotating cammed shaft 220 to allow smoother turning of the rotating cammed shaft 220.

When the turntable 32 rotates, it will turn drive wheel 230 which will turn the lower rotating cammed shaft 220. The cammed end of shaft 210 rests on top of the cammed end of shaft 220. Rotating cammed shaft 220, moves the upper cammed shaft 210 up and down through distance "X". The mixing blade 76 travels up and down by the same amount that the upper cammed shaft 210 travels. Movement of the blade 76 will further enhance the mixing action.

The material used for all the mixing attachments shown should be transparent to microwave energy. In some cases, metal materials could be used; however, each part should be evaluated on an individual basis for proper material choice, and designed for proper interaction with the microwave energy to which it would be exposed.

This concludes the Description of the Preferred Embodiments. A reading of by those skilled in the art will bring to mind many modifications and alternatives without departing from the spirit and scope of the invention. Accordingly, it is intended that the invention only be limited by the following claims.

What is claimed is:

1. Apparatus for mixing food while heating with microwave energy, comprising:

a microwave cavity comprising first and second opposing walls;

means for energizing said oven cavity with microwave energy;

a utensil for holding food, said utensil being disposed within said oven cavity;

a turntable for rotating said utensil;

a shaft extending downwardly into said utensil; and means for holding said shaft in a fixed position said holding means comprising a substantially horizontal bar having an adjustable length, said bar having ends engaging said opposing walls of said microwave cavity wherein, when said utensil containing food is rotated, said food is mixed by flowing across said shaft.

2. The apparatus as recited in claim 1 further comprising a paddle connected to said shaft.

3. The apparatus as recited in claim 1 wherein the bottom of said shaft is wider and flatter than the top of said shaft.

4. An apparatus comprising:

a microwave oven having a cavity comprising first and second opposing walls;

a container disposed within said cavity for holding food;

a turntable for rotating said container;

a shaft removably positioned in said cavity of said microwave oven, said shaft extending downwardly into said container; and means for supporting said shaft in an elevated position, said supporting means comprising a horizontal member having an adjustable length for suspending between said opposing walls, said supporting means further comprising:

means for attaching the upper section of said shaft to said horizontal member; and means connected to the lower section of said shaft for contacting said food wherein, when said container is rotated, said food is mixed by flowing past said contacting means.

5. The apparatus as recited in claim 4 wherein said attaching means comprises means for adjusting the height of said contacting means in said container.

6. The apparatus as recited in claim 4 wherein said contacting means is removable from said shaft.

7. An apparatus comprising:

a microwave oven having a cavity with two opposing side walls;

a microwave transparent vertically oriented shaft removably positioned in said cavity within said oven, said shaft extending downward into food in a rotating container;

a microwave transparent horizontal arm;

means for fastening both ends of said arm to said opposing walls in an elevated position;

means coupled to said arm for attaching the top of said shaft to said arm, said arm comprising:

(a) a first arm section, said first arm section having a constant external diameter from end portion to end portion;

(b) the outer end portion of said first arm section connected to said fastening means;

(c) the inner end portion of said first arm section having an opening therein of a size to receive;

(d) a second arm section, said second arm section having a constant nominal external diameter from end portion to end portion;

(e) the outer end portion of said second arm section connected to said fastening means;

(f) said second arm section being telescopically, slidably received within the first arm section;

(g) means connected to said first and section arm section for adjusting the length of the arm assembly within the limits of the range of telescoping movement;

a microwave transparent blade adapted to be in contact with said food; and means for securing the bottom of said shaft to said blade.

8. An apparatus comprising:

a microwave oven;

a microwave transparent shaft removably positioned in the cavity of said microwave oven, said shaft extending downwardly for inserting into food in a rotating container on a turntable;

a vertically oriented hollow tube containing a first cammed shaft over a second cammed shaft;

means for preventing rotation of said first cammed shaft;

means for securing said tube to said oven;

a drive wheel comprising a permanently centered shaft fastened to said oven;

means for connecting said drive wheel to said turntable to rotate said drive wheel;

means for connecting said drive wheel to said second cammed shaft to rotate said second cammed shaft;

a horizontal arm located above said downwardly extending shaft and said first cammed shaft;

means for fastening one end of said horizontal shaft to the top of said first cammed shaft; and means for fastening said horizontal shaft to the top of said downwardly extending shaft.

9. An apparatus recited in claim 8 further comprising a blade coupled to the bottom of said shaft wherein said food is mixed by flowing across said blade.

10. The method of stirring food in a microwave oven cavity, comprising the steps of:

positioning said food to be stirred in a container within the cavity of said microwave oven;

supporting with a telescopically adjustable horizontal arm, a shaft extending downwardly into said food in a container;

adjusting the length of said horizontal arm to contact said opposing walls;

rotating said container; and holding said shaft in a fixed position relative to said rotating food wherein said food is mixed by flowing across said shaft.

11. An apparatus for mixing food in a rotating utensil comprising:

a vertically oriented shaft;

a substantially horizontal arm comprising:

(a) a first arm section having a substantially constant external diameter from end portion to end portion;

(b) the inner end portion of said first arm section having an opening therein of a size to receive;

(c) a second arm section having a substantially constant external diameter from end portion to end portion;

(d) said second arm section being telescopically slidably received within the first arm section;

(e) means connected to said first and second arm section for adjusting the length of the arm assembly within the limits of the range of telescoping movement;

means for fastening the outer end of said first arm section to a first vertical surface;

means for fastening the outer end of said second arm section to a second vertical surface; and means coupled to said horizontal arm for attaching the top of said shaft to said arm.

12. The apparatus as recited in claim 11 further comprising:

a microwave transparent blade; and means for securing the bottom of said shaft to said blade.

13. The apparatus as recited in claim 11 wherein said shaft extends downward into said food in said rotating container wherein said food is mixed by flowing across said shaft.

14. The apparatus as recited in claim 11 wherein the bottom of said shaft is wider than the top of said shaft.

15. The apparatus as recited in claim 11 wherein the first and second vertical surfaces are opposing walls of a microwave oven cavity.

16. An apparatus comprising:

a shaft extending downwardly for inserting into food in a rotating container on a turntable;

a vertically oriented hollow tube containing a first cammed shaft over a second cammed shaft;

means for preventing rotation of said first cammed shaft;

means for securing said tube to a microwave oven cavity floor;

a drive wheel comprising a permanently centered shaft adapted to be fastened to said microwave oven cavity floor;

means for connecting said drive wheel to said turntable to rotate said drive wheel;

means for connecting said drive wheel to said second cammed shaft to rotate said second cammed shaft;

a horizontal arm located above said downwardly extending shaft and said first cammed shaft;

means for fastening one end of said horizontal shaft to the top of said first cammed shaft; and means for fastening said horizontal shaft to the top of said downwardly extending shaft.

17. The apparatus recited in claim 16 further comprising a blade coupled to the bottom of said shaft wherein said food is mixed by flowing across said blade.

* * * * *